US005257870A

United States Patent [19]

Bennett et al.

[11] Patent Number: 5,257,870

[45] Date of Patent: Nov. 2, 1993

[54] PAPER RETAINING MEANS

[75] Inventors: John Bennett, Fulham Gardens; Howard K. Schulze, Marino, both of Australia

[73] Assignee: Mondami Trading Pty. Ltd., Australia

[21] Appl. No.: 929,320

[22] Filed: Aug. 12, 1992

[30] Foreign Application Priority Data

Aug. 12, 1991 [AU] Australia ..... PK7702

[51] Int. Cl.[5] ..... B42F 3/00

[52] U.S. Cl. ..... 402/63; 402/62; 402/15

[58] Field of Search ..... 402/63, 68, 62, 15, 402/80, 61

[56] References Cited

U.S. PATENT DOCUMENTS 4,305,675 12/1981 Jacinto ..... 402/63

4,979,841 12/1990 Lauder ..... 402/68

FOREIGN PATENT DOCUMENTS 2647044 4/1978 Fed. Rep. of Germany ..... 402/63

*Primary Examiner*—Mark Rosenbaum

*Assistant Examiner*—Willmon Fridie, Jr.

*Attorney, Agent, or Firm*—Quarles & Brady

[57] ABSTRACT

A paper retaining means is disclosed which can be used to clamp loose-leaf stationery. The invention consists of a base from which extends two fingers spaced apart a selected distance and a clamping member having two apertures spaced apart the same distance as the respective said two fingers. Adjacent to an upper part of the clamping member are two clips adapted to grip a respective part of a finger.

11 Claims, 3 Drawing Sheets

PAPER RETAINING MEANS

This invention relates to paper retaining means.

BACKGROUND OF THE INVENTION

It is known to use two members one of which has a base from which extends two fingers. The two fingers pass through respective apertures within a support sheet and through apertures in papers to be held and subsequently engaged with a clamping member. The purpose of this invention is to provide an apparatus of this type which has improvements and avoids the difficulties experienced with previous devices.

SUMMARY OF THE INVENTION

According to one form of this invention there is provided a paper retaining means comprising a base, two fingers extending from the base and spaced apart a selected distance to an appropriate distance passing through spaced apart apertures within a backing sheet, and a clamping member, the clamping member including two apertures passing therethrough and spaced apart the same distance as the respective fingers on the base part, and adjacent an upper part of such clamping member a clip part adapted to engage with a gripping hold a respective part of a finger.

Alternatively, in another form of this invention there is provided a paper retaining means comprising a base from which extends two fingers spaced apart a selected distance, and a clamping member having two apertures spaced apart the same distance as the respective said two fingers, and at least one clip part adjacent an upper part of said clamping member, said clip part being adapted to grip a respective part of at least one of said fingers.

In preference, the clip part is defined by a right angular shaped part in cross section which extends from a substantially planar said base and then extends at right angles across a finger ensnaring area to a free end, leaving thereby access into the ensnaring area from an open side of the clip part, defined between the clamping member and the free end of the clip part.

In preference, the underneath shape of the right angle part defining the clip shape includes a downwardly extending step adapted to resist removal of a finger once located therein, and interengaging teeth with similarly shaped teeth on a respective finger such as to provide interlocking engagement therebetween when the finger is pulled therethrough.

In use, one of the difficulties for a user is to immediately ascertain, having pulled a finger through an aperture in the clamped member, as to what side the clip has an open end. Therefore there is provided that the clip part is defined by a rectangular shape having in preference an externally apparent tapered shape on the side of the clip shape into which the finger is to be engaged.

A problem that has been experienced has been that in some cases, if the clip shape is on an outer side from the aperture, then if the finger is pulled through only a relatively small bunch of papers and then clipped off, there is a substantial length of finger that will be necessarily left to extend out to the side of the paper retaining means. This can interfere with later closing of a folder and it has been a discovery that this concept can be rearranged so that a clip can be located on an innerside of a respective aperture so that the fingers after being captured within the clip shape can fold inwardly rather than outwardly.

In a preferred arrangement noting that none of the said points are essential to at least the broader concept of this invention, the finger can have appropriate interengaging teeth on opposite sides and there can be clip shapes on both sides of each of a respective aperture through the base of a clamped part so that either an outwardly or inwardly location of the finger can be used.

In preference, the open side of at least one clip shape located at one of said base, faces opposite to that of the open side of at least one clip shape located at the other end of said base, particularly where these clip shapes are on an innerside of the respective apertures.

The invention will be better understood when described with reference to a preferred embodiment which will now be described with the assistance of drawings in which:

DESCRIPTION OF THE PREFERRED EMBODIMENTS

Figure 1A:
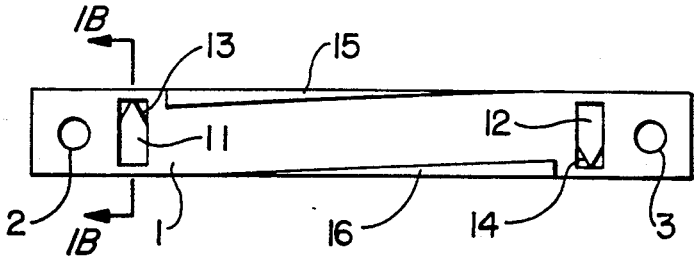
FIG. 1A is a plan view of a clamped part according to first embodiment.
Figure 1B:
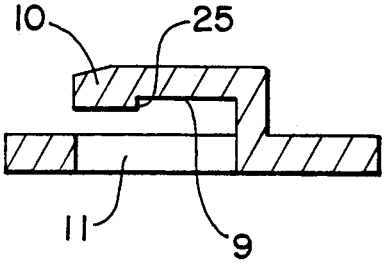
FIG. 1B is a sectional view through 1B—1B of FIG. 1A.
Figure 2A:
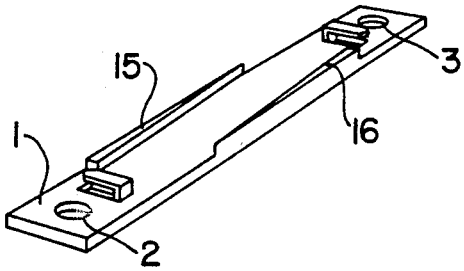
FIG. 2A is a perspective view according to the first embodiment as shown in FIG. 1A.
Figure 2B:
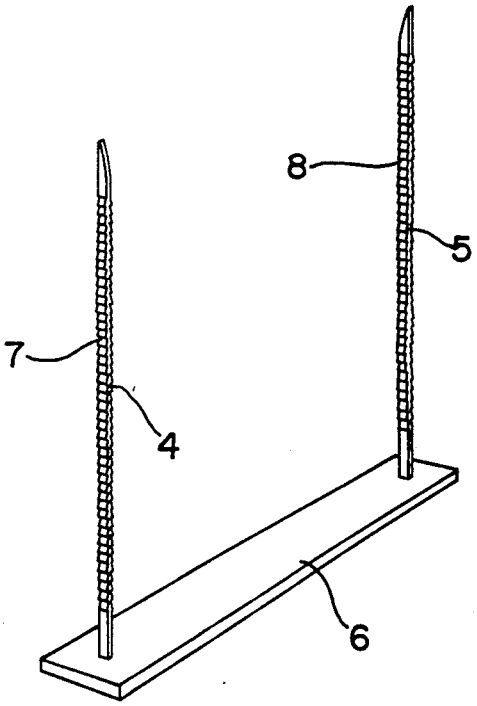
FIG. 2B is the base part with attached fingers that is adapted to be used in conjunction with the clamped part as shown in FIGS. 1A and 2A.
Figure 3:
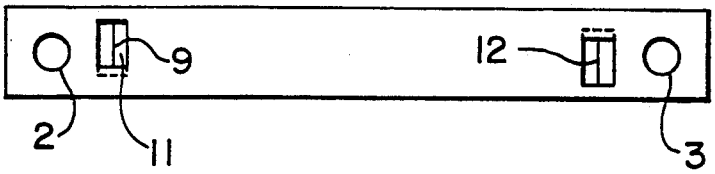
FIG. 3 is an underneath view of the clamped part as shown in FIGS. 1A and 2A.

Referring in detail to the drawings there is shown, in FIGS. 1A, 1B, 2A, 2B and 3, a clamp part 1 which is manufactured by injection moulding from a plastics material such as nylon and has a substantially rectangular shape in plan and is substantially planar in general alignment. The clamp part 1 has apertures 2 and 3 passing fully therethrough the size and location being such that fingers 4 and 5 attached to the base part 6 can pass therethrough.

The base part 6 together with its fingers 4 and 5 is also manufactured by injection moulding from a nylon plastics material and its shape and distance apart of the fingers is such that these are compatible with the location of the apertures 2 and 3. In this way of course the fingers 4 and 5 can pass through appropriated apertures in sheets of paper, card or folders and thereby clamp the papers subsequently thereto.

On a outer side of the respective fingers 4 and 5 are teeth 7 and 8 which are adapted to interengage with teeth located at 9 beneath the right angular part 10 defining a clip part 11.

There are two clip parts shown namely one at 11 and another at 12 each of these defining there beneath a clipping space and there is indicated by reason of the arrow shape shown at 13 in one case and 14 in the other location of the open gap side of the clipping space defined between a free end of the respective clipping part and an upper face of the clamping member.

In this first example it will be seen that the clip part 11 and 12 are on the innerside with respect to the apertures 2 and 3 so that the fingers 4 and 5 in order to be capturing the clipping part will have to be bent inward and therefore to some extent cross over one another. A strengthening rib and guide is located on both sides of the base of the clamp part 1 these being shown at 15 and 16.

Figure 4:
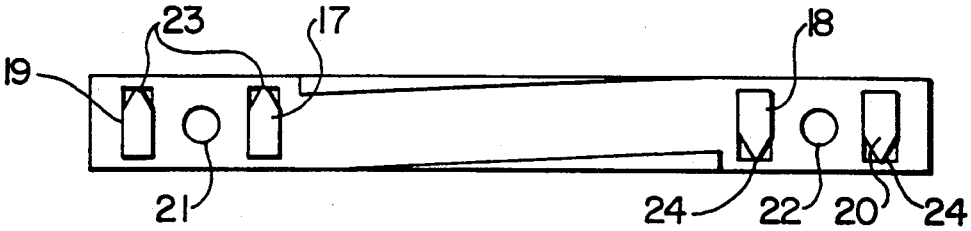
FIG. 4 is a plan view of a second embodiment.
Figure 5:
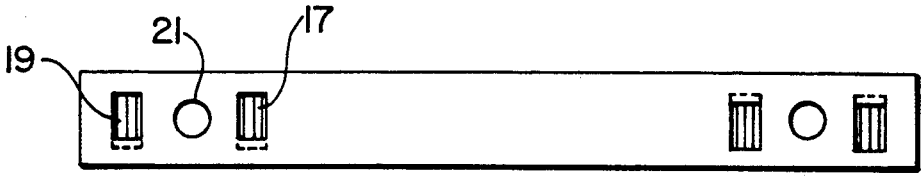
FIG. 5 is the underneath view of the embodiment as shown in FIG. 4.

In the second embodiment, FIG. 4 and FIG. 5, the arrangement is the same so far as a first clipping part shown at 17 and 18 is concerned but there is the addition of an outer clipping part 19 in the one instance and 20 in the other each relevant to aperture 21 in the one case and 22 in the other. In both cases, there is a tapered shape shown at 23 in the one case and 24 in the other to indicate the side that has the open aperture but otherwise the shape underneath is the same defined by a right angle part, interlocking teeth and a step as shown at 25 of FIG. 3.

Figure 7:
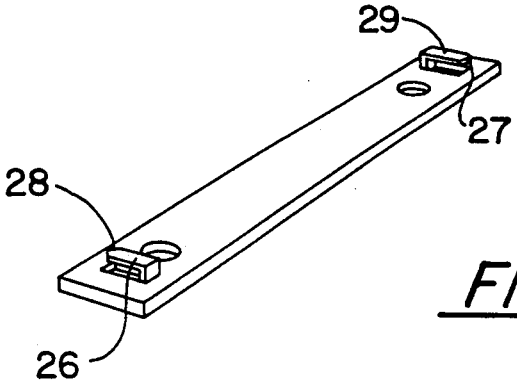
FIG. 7 is a perspective view of a third embodiment showing specifically the clamp part.
Figure 6:
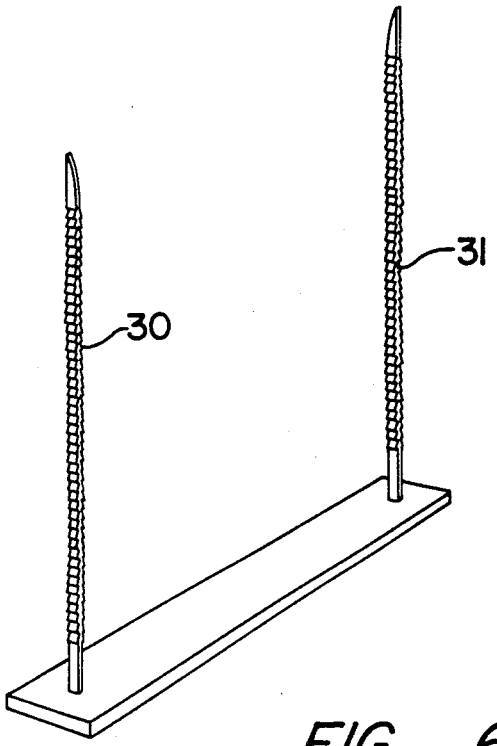
FIG. 6 is a base part which can be used in conjunction with the second embodiment but only in respect of the outer side clips.

In the case of the third embodiment, FIG. 7, which has a clipped part on the outer side with respect to the apertures. This has the shape as shown in both of the previous embodiments, each of the clip parts being shown at 26 and 27 and having a tapered side at 28 in the one case 29 in the other to illustrate which way the finger 30 or 31 is to be located beneath the interlocking shape. The base of FIG. 6 should be used with the outer side clip parts so that the teeth 30 and 31 can engage the clip parts. In a further embodiment (not shown) the teeth can be located on both sides of the fingers so that the base can be used on inner or outer grips.

Figure 8:
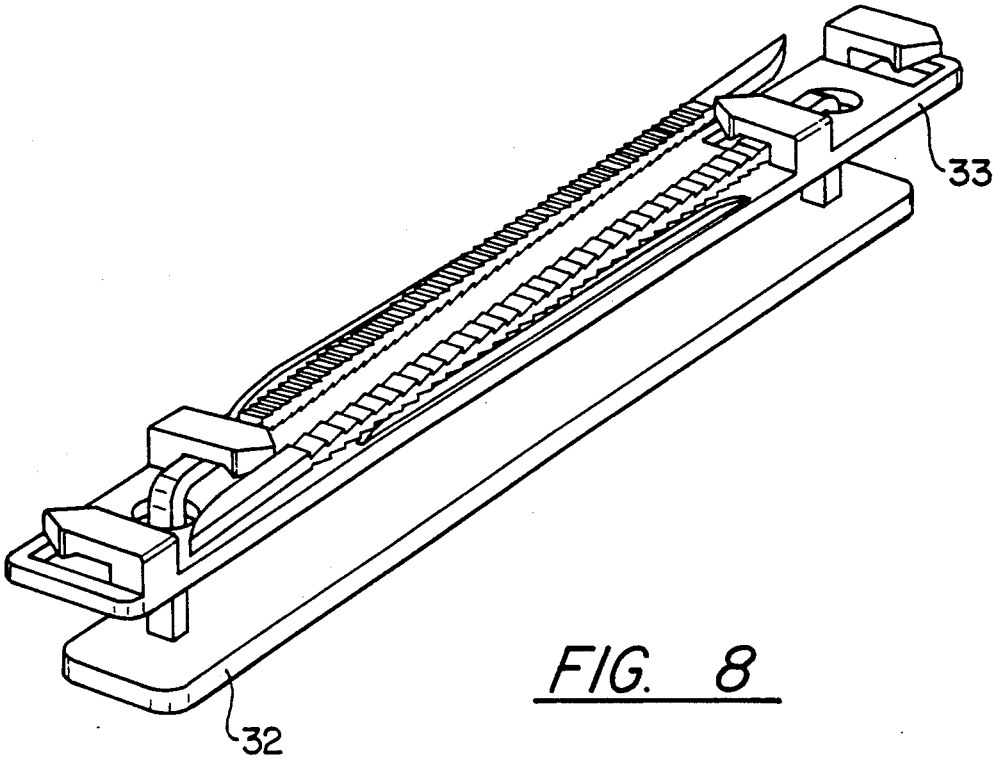
FIG. 8 is a perspective view of a clamp part joined with a base according to a fourth embodiment.

In FIG. 8 base part 32 is joined in typical fashion with clamp part 33. The parts are the same in each case being manufactured from injection moulded plastic and the plastics material being that which is appropriate to the application but thus far having been found to be nylon.

This describes the embodiments from which it can be seen how this allows for an improvement in relation to clipping systems hitherto available.

Throughout this specification the purpose has been to illustrate the invention and not to limit it.

We claim:

1. A paper retaining means comprising:

a base;

two fingers having teeth, the two fingers extending from the base and being spaced apart a selected distance;

a clamping member having two apertures, passing therethrough and being spaced apart the same distance as the selected distance of the respective fingers on the base, the apertures providing passages through the clamping member for the respective fingers; and a clip part attached to an upper face of the clamping member, the clip part having teeth facing the upper face of the clamping member, and the teeth of the clip part being adapted to engage a portion of the teeth of each of the fingers.

2. A paper retaining means as in claim 1, in which there are teeth on opposite sides of each of the said fingers.

3. A paper retaining means comprising:

a base;

two fingers having teeth, the two fingers extending from the base and being spaced apart a selected distance;

a clamping member having two apertures, passing therethrough and being spaced apart the same distance as the selected distance of the respective fingers on the base, the apertures providing passages through the clamping member for the respective fingers; and two clip parts attached to an upper face of the clamping member, the two clip parts having teeth facing the upper face of the clamping member, the teeth of each of the two clip parts being adapted to engage a portion of the teeth of a respective finger.

4. A paper retaining means as in claim 3, in which each of the clip parts are defined by a right angle shaped part in cross section which extends perpendicular from the base and then extends at a right angle above the upper face of the clamping member to a free end to provide a finger ensnaring area.

5. A paper retaining means as in claim 4, in which the clip part tapers toward the free end of the clip part.

6. A paper retaining means as in claim 3, in which there are teeth on opposite sides of each of the said fingers.

7. A paper retaining means comprising:

a base;

two fingers having teeth, the two fingers extending from the base and being spaced apart a selected distance;

a clamping member having two apertures, passing therethrough and being spaced apart the same distance as the selected distance of the respective fingers on the base, the apertures providing passages through the clamping member for the respective fingers; and two clip parts attached to an upper face of the clamping member, the two clip parts having teeth facing the upper face of the clamping member, the teeth of each of the two clip parts being adapted to engage a portion of the teeth of a respective finger, in which each of the clip parts are defined by a right angle shaped part in cross section which extends perpendicular from the base and then extends at a right angle above the upper face of the clamping member to a free end to provide a finger ensnaring area, wherein the finger ensnaring area of the right angle shaped part defining the clip shape includes a step downwardly extending toward the upper face adapted to resist removal of one of said fingers once located therein, and the finger ensnaring area of the right angle shaped part further includes said teeth facing the upper face of the clamping member to provide an interlocking engagement of one of said fingers.

8. A paper retaining means as in claim 7, in which the clip part tapers toward the free end of the clip part.

9. A paper retaining means as in claim 7, in which there are teeth on opposite sides of each of the said fingers.

10. A paper retaining means as in claim 7, in which an open side between the upper face and the free end of at least one of the right angle shaped clip parts is located at one end of the clamping member and faces opposite to that of an open side between the upper face and the free end of at least one of the right angle shaped clip parts located at the other end of the clamping member.

11. A paper retaining means comprising:

a base;

two fingers having teeth on opposite sides of each of the two fingers, the two fingers extending from the base and being spaced apart a selected distance;

a clamping member having two apertures passing therethrough and spaced apart the same distance as the respective fingers on the base, the apertures providing passages through the clamping member for the respective fingers; and four clip parts attached to an upper face of the clamping member, two of the four clip parts being located on either side of one of the apertures to provide either a laterally outward or inward securing location of one of the fingers and the other two of the four clip parts being located on either side of the other one of the apertures to provide either a laterally outward or inward securing location of the other finger, and the four clip parts having teeth facing the clamping member such that the teeth of each of four clip parts are adapted to engage a portion of the teeth of a respective finger to provide either a laterally outward or inward securing location of said fingers.

* * * * *